United States Patent [19]

Miyai et al.

[11] Patent Number: 4,609,281

[45] Date of Patent: Sep. 2, 1986

[54] PORTABLE ELECTROSTATOGRAPHIC COPYING MACHINE

[75] Inventors: Kiyoshi Miyai; Shuhei Uotani, both of Himeji; Toyohiko Tsunemine, Hyogo, all of Japan

[73] Assignee: Sanyo Electric Co., Ltd., Japan

[21] Appl. No.: 698,606

[22] Filed: Feb. 6, 1985

[30] Foreign Application Priority Data

| | | | |
|---|---|---|---|
| Feb. 8, 1984 | [JP] | Japan | 59-22092 |
| Feb. 20, 1984 | [JP] | Japan | 59-30742 |
| Feb. 22, 1984 | [JP] | Japan | 59-33130 |

[51] Int. Cl.[4] ..... G03G 15/00

[52] U.S. Cl. ..... 355/3 R; 355/3 SH; 355/21; 355/8; 294/139

[58] Field of Search ..... 355/3 R, 3 DR, 3 BE, 355/14 R, 21, 3 SH, 72, 8; 294/138, 139, 141

[56] References Cited

U.S. PATENT DOCUMENTS

| | | | |
|---|---|---|---|
| 3,286,589 | 11/1966 | Glidden | 355/21 |
| 4,181,424 | 1/1980 | Okada et al. | 355/8 |
| 4,456,362 | 6/1984 | Masaki | 355/3 R |
| 4,465,359 | 8/1984 | Nakahata | 355/3 R |
| 4,490,033 | 12/1984 | Gage et al. | 355/3 R X |
| 4,521,099 | 6/1985 | Katayama et al. | 355/8 |

FOREIGN PATENT DOCUMENTS

| | | |
|---|---|---|
| 56-11474 | 2/1981 | Japan . |
| 57-6858 | 1/1982 | Japan . |

*Primary Examiner*—A. C. Prescott

*Attorney, Agent, or Firm*—Darby & Darby

[57] ABSTRACT

A relatively small and lightweight electrophotographic apparatus includes a support plate for receiving originals, whereby the support plate reciprocates laterally between the front and back sides of the housing for the apparatus, wherein the center of gravity of the apparatus is biased away from the dimensional center of the housing or body toward the one of the front and back sides which the original support plate more greatly extends beyond and away from the body during reciprocation for scanning of originals, whereby even when heavy originals are placed on the original support plate, the apparatus does not tilt or incline away from its resting surface, even when the original support plate is in greatest extension beyond the body or housing. A handle, sheet feed cassette, and sheet feed tray are all mounted on or through one end of the housing to prevent the latter two from dropping out during transport, thereby facilitating transport.

5 Claims, 12 Drawing Figures

PORTABLE ELECTROSTATOGRAPHIC COPYING MACHINE

BACKGROUND OF THE INVENTION

1. Field of the Invention

This invention relates to an electrostatographic apparatus, such as an electrophotographic copying apparatus or a printer, small-sized and light-weighted.

2. Description of the Prior Art

Conventionally, the electrographic copying apparatus was heavy and large-sized, so that transportation thereof required two persons.

Therefore, recently, a small-sized and light weight electrographic copying apparatus has been developed, which is 20 kg or less in weight and transportable by only one person. Such electrographic copying apparatus usually is adapted to horizontally slide an original support plate for scanning. The copying apparatus of original support plate sliding type, when promoted to miniaturization and light weight, has the original support plate slided outwardly from the body of copying apparatus so that the originals larger in thickness, when intended to be copied, largely weigh the original support plate sliding outwardly from the body, or are placed to exert pressure to the plate, thereby having had a fear that the side counter to the sliding out side of the plate may lift and the body may inclined. Furthermore, the original support plate, which usually is made of glass, inclines while being out of the body, thereby causing a breakdown of a glass plate when the original support plate hit the pedestral of copying apparatus.

Also, the conventional electrographic copying apparatus has at four corners handles capable of horizontally projecting and retracting, so that two persons each grip the two projecting handles to lift the apparatus for transportation.

While, an electrographic copying apparatus recently developed small-sized and lightweighted is transportable by one person, but he must hold up by his both hands the copying machine at both side of the bottom thereof, which has not been easy to transport.

The copying apparatus provided at one side wall of the body with a handle is disclosed in the Japanese Patent Laid-Open No. 56-11474 (1981), which is not an original support plate sliding type. The copying apparatus of the original support plate sliding type, when provided with the handle at one side wall in the sliding direction of the plate, is transportable by one person while gripping the handle by his one hand. In this case, there is a fear that when he lifts the copying apparatus through the handle kept upwardly, the original support plate is intended to slide vertically to fall down along the body of apparatus, thereby requiring lock means for the original support plate. However, in a case where the person forgets to lock the original support plate, or the locking means is broken, the original support plate may fall down and lead to a breakdown thereof because of being ordinarily made from glass.

Also, in a case where the handle is provided at a side wall reverse to that mounting a sheet feed cassette, the cassette should be removed from the body during the transportation because when the copying apparatus is lifted keeping the handle upward and leaving the sheet feed cassette attached, there is a fear that the sheet feed cassette falls down to lead to its breakdown.

OBJECTS OF THE INVENTION

In the light of the above problems, this invention has been designed.

A first object of the invention is to provide an electrostatographic apparatus, whose body is even small-sized and lightweighted, has no fear of inclining during the copying operation.

A second object of the invention is to provide an electrostatographic apparatus having no fear of breaking down an original support plate during the transportation of the apparatus.

A third object of the invention is to provide an electrostatographic apparatus having no fear that accessories, such as a sheet feed cassette and a sheet discharge tray or the like, are broken down during the transportation of the apparatus.

A fourth object of the invention is to provide an electrostatographic apparatus easy to lift for transportation and preventable from an impact onto the apparatus body when installed and saving a space for placing the same when not in use.

The above and further objects and features of the invention will more fully be apparent from the following detailed description with reference to accompanying drawings.

DETAILED DESCRIPTION OF THE INVENTION

Figure 1:
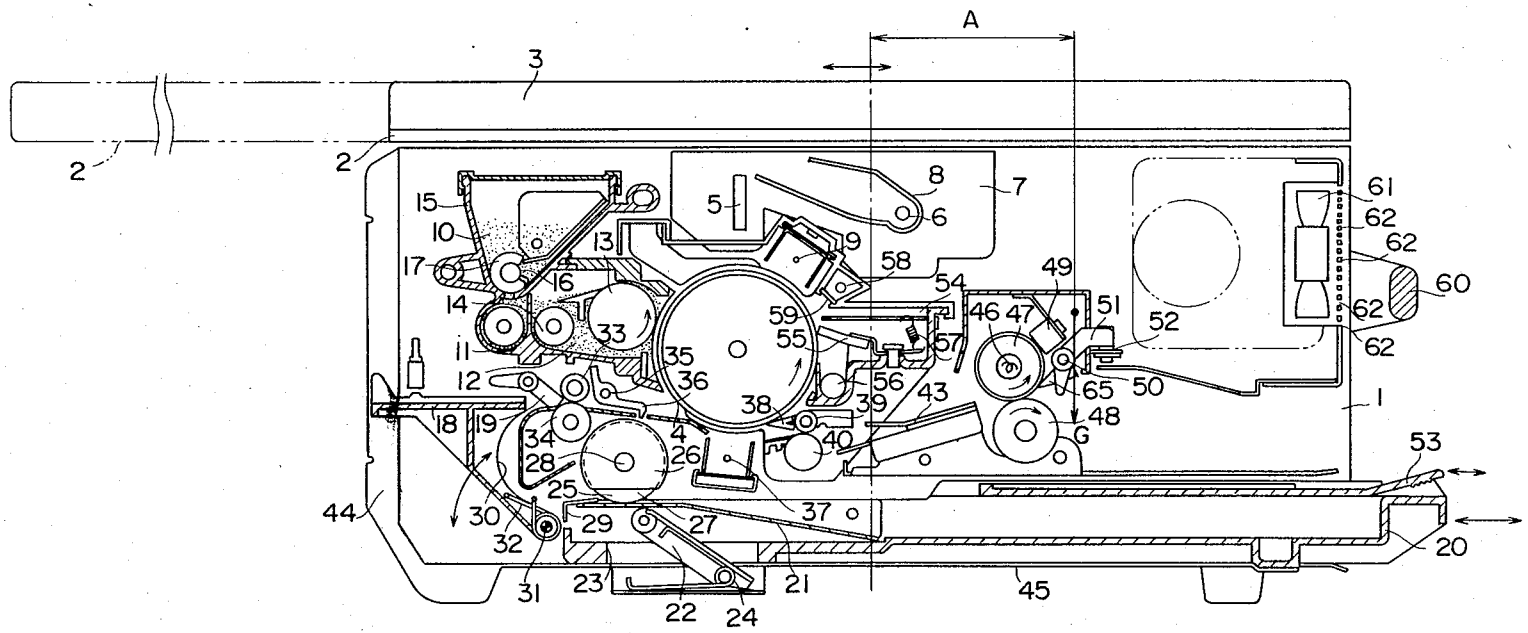
FIG. 1 is a longitudinal sectional view of an embodiment of an electrostatographic apparatus of the invention.

Referring to FIG. 1, reference numeral 1 designates the body of the electrostatographic apparatus of the invention, and at the upper surface of the body 1 is disposed slidably an original support plate 2 of transparent glass and movable horizontally, so that a cover 3 for holding the original is mounted onto the original support plate 2 in relation of freely closing and opening, and 4 designates a photosensitive drum comprising a cylinder of aluminum, whose peripheral surface is coated with polyvinyl carbazole. A short focus lens train 5 for forming on the peripheral surface of photosensitive drum 4 images of the original placed on the original support plate 2 is suspended opposite to the top of photosensitive drum 4. Rightwardly in the FIG. 1 of the short focus lens train 5 is provided an exposing lamp 6 (halogen lamp) which serves to illuminate the face of original and provides a reflector 8 elliptic in section, the short focus lens train 5 and exposing lamp 6 being fixed on a common chassis.

At the upstream side of short focus lens train 5 in the rotation direction of photosensitive drum 4 is fixed an electrifying corotron 9 for uniformly pluselectrifying (at about 600 V) the photosensitive drum 4.

At the downstread side of lens train 5 in the rotation direction of photosensitive drum 4 is provided a developing unit 11 for developing with toner 10 electrostatic latent images formed on the photosensitive drum 4 by means of electrifying corotron 9 and short focus lens train 5 and the like, the developing unit 11 housing therein a magnet roller 13 for transporting toward the surface of electrosensitive drum 4 a developer 12 of mixture of toner 10 and a carrier and a screw 14 for mixing the toner and carrier, the roller 13 and screw 15 being rotatable in the developing unit 11. Reference numeral 15 designates a toner hopper fixed integrally with the upper portion of developing unit 11. The toner hopper 15 provides at the bottom thereof a sponge roller 17 having a cutout 16 in part for feeding the contained toner 10 little by little to the developing unit 11.

Reference numeral 18 designates a sheet feed table for manually feeding a copy paper into the apparatus and at the downstream side of sheet feed table 18 in the paper feed direction is provided a start switch 19 serving also as a jam sensor, and 20 designates a sheet feed cassette mounted detachably and horizontally to the inner bottom of the body 1 of electrostatographic apparatus. The sheet feed cassette 20 is insertably mounted leftwardly of the body 1 from the right hand thereof and provides on the bottom inner surface a support plate 21 swingably up and downwardly and for loading sheet of copy papers (not shown), and below the support plate 21 is provided an opening 23 through which the free end of a push-up lever 22 mounted swingably up and downwardly into a portion projecting outwardly from the bottom of body 1 is passable, the push-up lever 22 providing a torsion spring 24 for biasing it to rotate clockwise so that the spring 24 biasing the support plate 21 upwardly. Above the end of sheet feed cassette 20 at the downstream side thereof is provided a sheet feed roller 26 for feeding a copy paper one by one and of a high frictional material, such as rubber, and having a cutout 25 in part. Reference numeral 27 designates an idler of low frictional material, such as plastics and fitted freely rotatably to a spindle 28 of sheet feed roller 26 in order to prevent the cutout 25 from contacting with the copy paper, and 29 designates a corner separator for separating the copy paper one by one.

At the downstream side of sheet feed cassette 20 in the paper feed direction is provided a guide 30 to turn upwardly the copy paper fed by the sheet feed roller 26, the guide 30 being integral with the manual sheet feed plate 18 and rotatable counterclockwise around a support spindle 31 inserted into the lower end of guide 30, and 32 designates a torsion spring for biasing the guide 30 clockwise.

At the downstream side of guide 30 in the paper feed direction is provided a pair of register rollers 33 and 34 for feeding in synchronism with sliding of original support plate 2 the copy paper transported from the sheet feed cassette 20 or sheet feed plate 18, the lower register roller 34 being connected to a drive source so as to rotate continuously. Also, the pair of register rollers 33 and 34 are in relatively light press-contact with each other and adapted to feed the copy paper when not restricted by other means (discussed below), but slip to the same when restricted by other means.

At the downstream side of pair of register rollers 33 and 34 in the paper feed direction is provided a stopper 36 mounted rotatably to a support spindle 35, the stopper 36 is bent in L-like shape at the free end and insertably engageable or disengageable at the tip thereof with or from a paper feed passage. Accordingly, when the tip of stopper 36 insertably engages with the paper feed passage, the copy paper fed is restricted at its fore end of the downstream side in the feed direction thereof by the tip of stopper 36, thereby being put in slip condition to the register rollers 33 and 34, and then the tip retracts to disengage from the paper feed passage at the proper timing, thereby refeeding by the register rollers 33 and 34 the copy paper having temporarily been stopped by the stopper 36.

Below the photosensitive drum 4 is provided a corotron 37 to transfer to the copy paper the toner images developed by the developing unit 11. At the downstream side of the transfer corotron 37 in the rotation direction of photosensitive drum 4 is disposed adjacent thereto a peel-off pawl 38 for peeling off the copied paper from the photosensitive drum 4, the peel-off pawl 38 being mounted rotatably to a support shaft for the upper one 39 of a pair of carrier rollers 39 and 40 and biased at the utmost end to rotate toward the peripheral surface of photosensitive drum 4.

At the downstream side of pair of carrier rollers 39 and 40 in the paper feed direction is provided a sheet feed guide 43 and at the downstream side thereof is provided a fixing unit comprising a heat roller 47 insertably supporting therein a halogen lamp 46 of about 800 W and a pressure roller 48 in press-contact with the heat roller 47.

Slantwise upwardly of the heat roller 47 is provided to be slidable thereto a temperature sensor 49 of silicon rubber and having a thermister embedded in the surface of sensor 49 and for sensing a temperature of heat roller 47. In addition, a peel-off pawl 65 for peeling the copy paper from the heat roller 47 is provided.

At the downstream side of the fixing unit in the paper feed direction is provided a C-like-shaped lever 51 supported at a portion lower than its center of gravity rotatably by a support spindle 50 and at the downstream side of lever 51 is provided a photocoupler 52 whose optical path is selectively interrupted by the lever 51. The photocoupler 52 serves as a sensor for the lever 51 and is connected to a copy start switch through a control circuit (both are not shown), so that when the lever 51 interrupts the optical path of photocoupler 52 in a stand-by condition for the copying operation, the copying operation is adapted not to start even when the copy start switch is actuated. Also, the lever 51, when the copy paper is discharged from the fixing unit, comes into contact with the copy paper and rotates counterclockwise around the support spindle 50 to release the interrupted optical path of photocoupler 52.

Now, the copy paper fixed of toner images by the fixing unit is discharged onto a sheet discharge tray 53 provided above the sheet feed cassette 20. In addition, the sheet discharge tray 53 is constructed to come out or retract longitudinally with respect to the body 1 and be housed therein when not used.

At the downstream side of peel-off pawl 38 in the rotation direction of photosensitive drum 4 (upwardly thereof in the drawing) is provided a cleaning unit 54 for removing from the photosensitive drum 4 the toner not completely transferred to the copy paper but remaining to the photosensitive drum 4, the cleaning unit 54 housing therein a rubber blade 55 for scraping off the residual toner from the photosensitive drum 4 and a screw conveyor 56 to discharge the scraped toner. The blade 55 is provided with a spring 57 for biasing the utmost end of blade 55 toward the photosensitive drum 4, an erase lamp 58 for removing the residual charge completely from the drum 4 is provided at the downstream side of cleaning unit 54 (upwardly in the drawing), and the erase lamp 58 has a filter 59.

A handle 60 to raise up or lift the body 1 of electrostatographic apparatus of the invention is fixed to the right-hand side-wall thereof, that is, the side wall onto which the sheet feed cassette 20 and discharge tray 53 are mounted. At the side wall reverse to the above, that is, at the left-hand side wall, are fixed prism-like-shaped rubber cushions 44 extending vertically in two rows, whose lower ends reach the bottom of the body 1 and function as legs for the electrostatographic apparatus, the rubber cushions 44 serving to protect the body 1 when lifted and then placed on the ground or the like. In addition, the bent portion of each cushion 44 is chamfered to be thinner to thereby prevent the corner of body 1 from hitting a pedestal when the body 1 is intended to be raised.

Also, reference numeral 61 designates a cooling fan provided inside the side wall fixedly supporting the handle 60, which exhausts air outwardly through a number of air exits 62, 62 . . . . Thus, in a case where the cooling fan 61 is provided at the side wall carrying the handle 60, the air exits 62, 62 . . . do not face the floor or the like even when the body 1 is raised while rotating the cooling fan 61, thereby not deteriorating the exhaust efficiency.

Now, after the original is placed on the original support plate 2, the copy start switch is energized, then the original support plate 2 is slided leftwardly, so that the original images are projected and image-formed on the photosensitive drum 4 during the sliding of original support plate 2 and the electrostatic latent images corresponding to the original images are formed on the photosensitive drum 4. In addition, it is noted that the original support plate 2 in this embodiment is adapted to be out of leftwardly only. Then, the electrostatic latent images are toner-developed at the developing unit 11 and the developed toner images are transferred by the transfer corotron 37 to the copy paper fed from the sheet feed cassette 20. Thus, the copy paper on which the toner images are transferred is peeled off by the peel-off pawl 30 from the photosensitive drum 4 and heated and pressurized by the fixing unit and thereafter discharged onto the sheet discharge tray 53.

In addition, the residual charge and toner which is not transferred to the copy paper but remains on the photosensitive drum 4 are removed therefrom by the erase lamp 58 and cleaning unit 54 respectively.

In the abovementioned electrostatographic apparatus, the center of gravity thereof is positioned apart rightwardly from the dimensional center of the body 1 by a dimension A.

Figure 2:
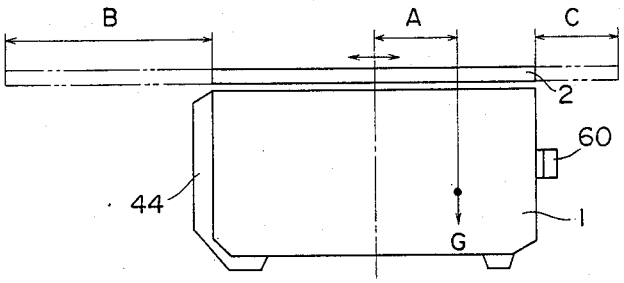
FIG. 2 is a schematic front view of a modified embodiment of the invention, FIGS. 3-(*a*) to -(*c*) are schematic front views explanatory of operation of the FIG. 2 embodiment of the invention.

FIG. 2 is a schematic front view of the electrostatographic apparatus of a type of being out of the original support plate 2 forwardly by a dimension B and backwardly by that C from the body 1, in which a relation of $B>C$ holds and the center of gravity G of body 1 is biased by a dimension A rightwardly from the dimensional center of body 1. In addition, internal construction of the apparatus shown in FIG. 2 is same as FIG. 1 embodiment.

Figure 3A:
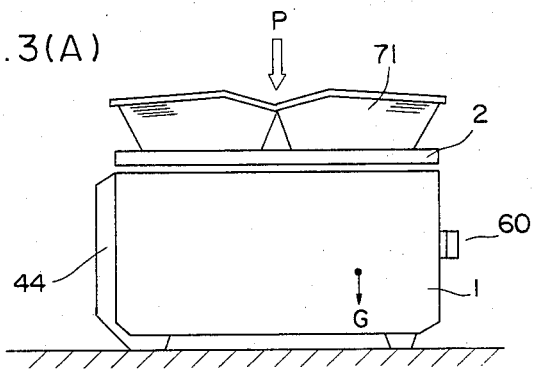
Figure 3B:
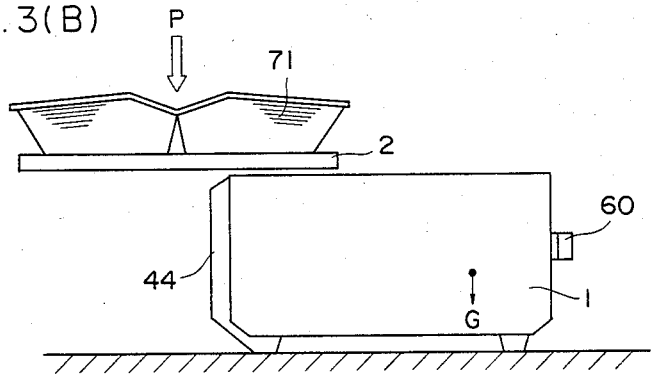
Figure 3C:
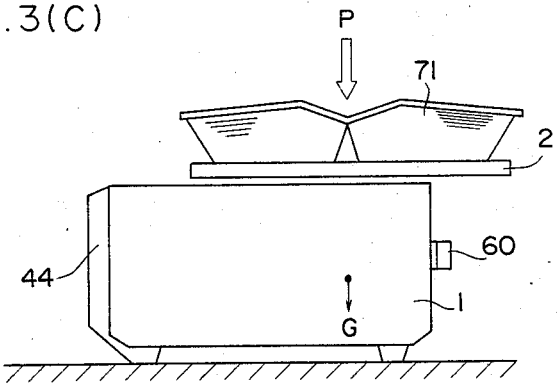

Now, in such photostatographic apparatus, originals 71 larger in thickness are placed on the original support plate 2 to start the copying as shown in FIGS. 3-(A) through -(C). In this case, the center of gravity of originals 71 is positioned at a point P. The point P, when the plate 2 slides out leftwardly from the body 1, comes out therefrom, but the center of gravity G of body 1 is biased rightwardly, whereby there is no fear that the body 1 is raised at the right-hand end to be intended to rotate counterclockwise around the left-hand lower end (see FIG. 3-(B)). When the original support plate 2 slides out rightwardly from the body 1, the center of gravity P of original 71 is positioned on the body 1, whereby the body 1, even when its center of gravity G is biased rightwardly, is prevented from rotating clockwise around the right-hand lower end of body 1 (see FIG. 3-(C)).

Figure 4:
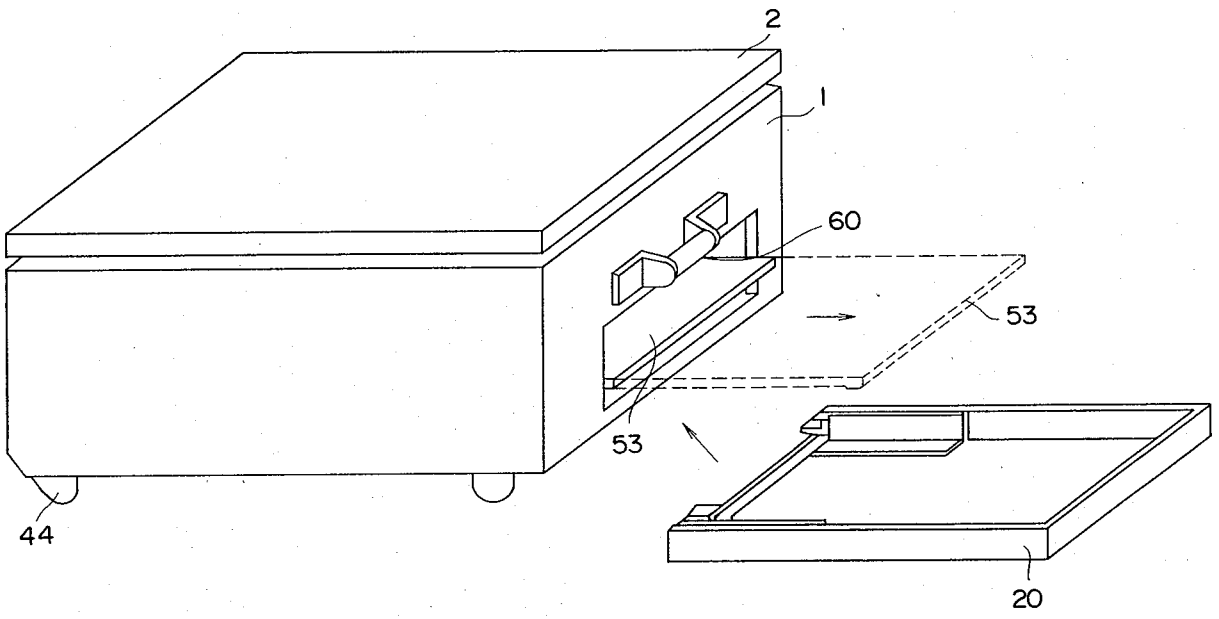
FIG. 4 is a perspective view of the electrostatographic apparatus of the invention in FIG. 1, FIGS. 5-(*a*) to -(*c*) are sectional views explanatory of the process of inclining at angle of 90° the body of the same.

FIG. 4 is a perspective view of this embodiment when viewed from the handle 60 side. As seen from FIG. 4, the sheet discharge tray 53 is constructed to be positioned as shown by both the solid and broken lines, thereby being drawn out to the position shown by the broken line when the electrostatographic apparatus operates, and retracted to the position shown by the solid line when the same does not operate, thus expecting to keep the apparatus compact during no operation. Also, the sheet feed cassette 20 is adapted to be mountable to the body 1 in the same direction as movement of discharge tray 53.

Figure 5A:
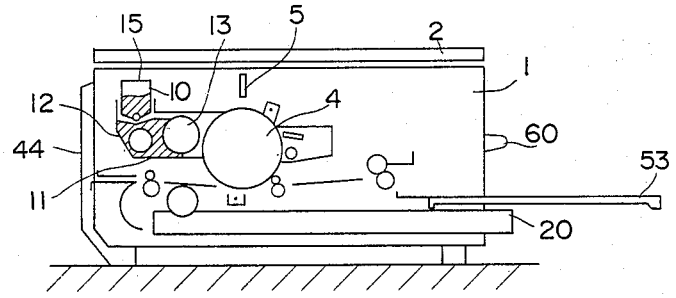
Figure 5B:
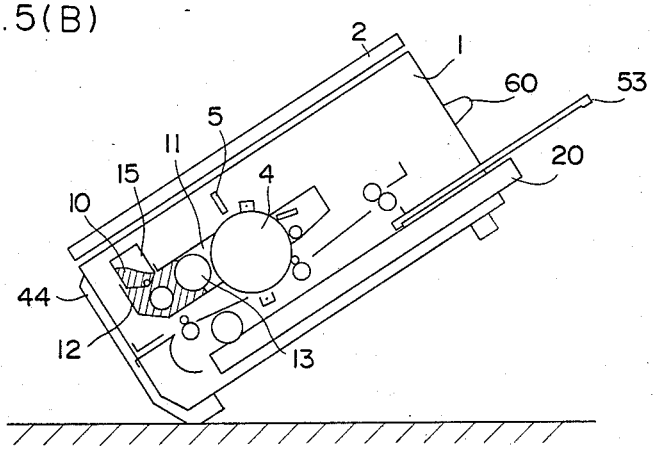
Figure 5C:
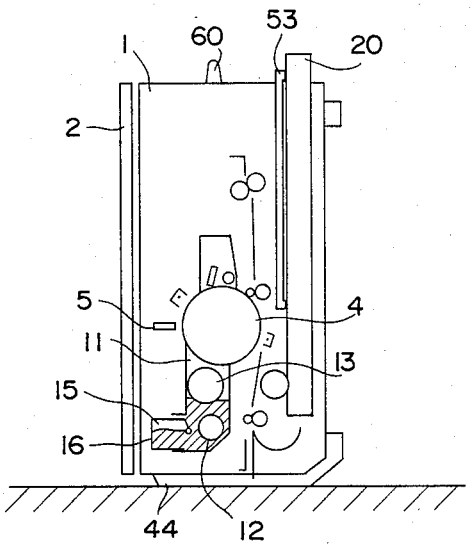

FIGS. 5-(A) through -(C) are sectional views of the electrostatographic apparatus, in which the body 1 thereof is rotated at an angle of 90° while holding the handle 60, and then raised upright on the floor. As seen from the same drawings, when the body 1 stands upright longitudinally thereof, the sheet discharge tray 53 is housed by its weight into the body 1. Also, the toner 10 in the toner hopper 15 and a developer 12 in the developing unit 11 are shifted reversely to the photosensitive drum 4.

Figure 6:
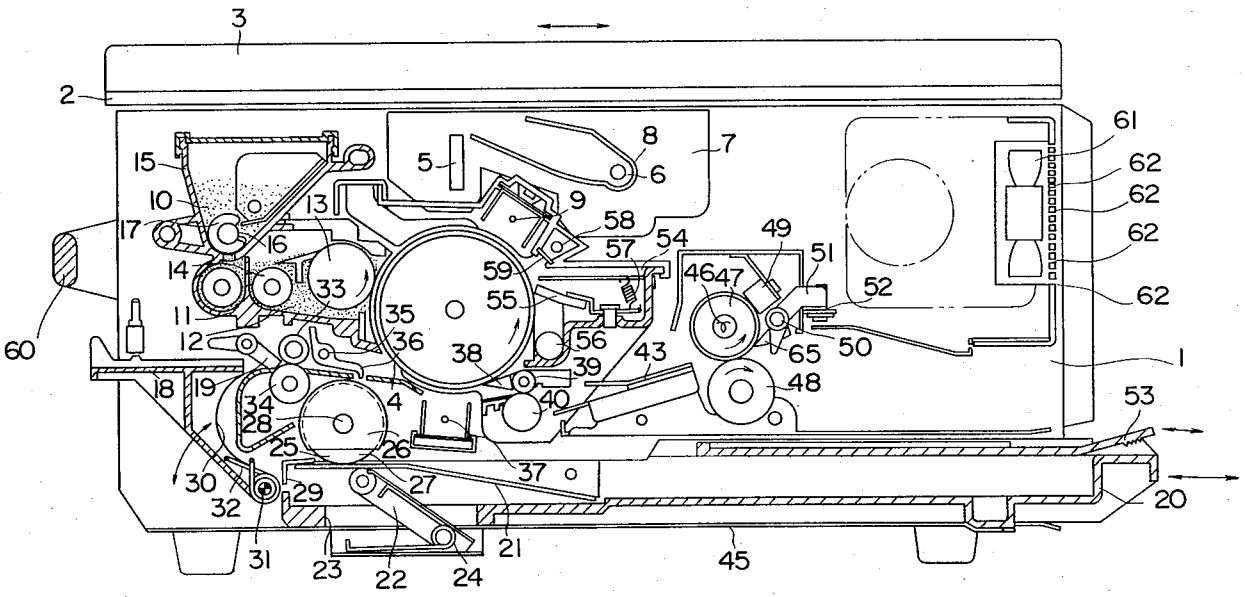
FIG. 6 is a longitudinal sectional view of another modified embodiment of the invention.

FIG. 6 shows another modified embodiment of the invention, which is of type of allowing the original support plate 2 to slide out longitudinally from both ends of the body 1, that is, leftwardly and rightwardly therefrom in FIG. 6, and a handle 60 is fixed to the left-hand side-wall of body 1 and prism-like-shaped rubber cushions 44 are fixed to the right-hand side-wall counter to the handle 60 fixing side-wall.

Figure 7:
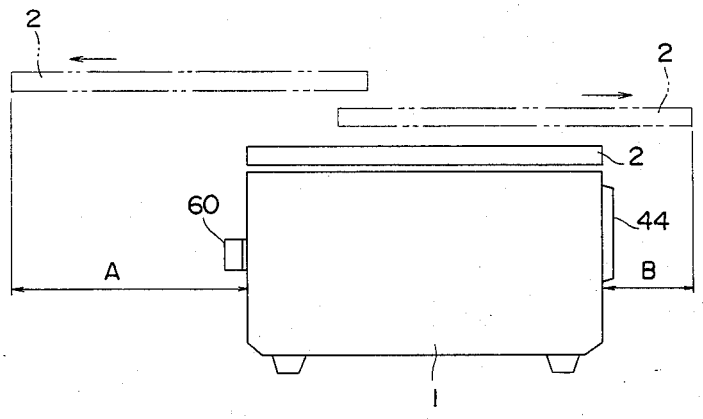
FIG. 7 is a schematic front view explanatory of operation of the FIG. 6 embodiment.

In such electrostatographic apparatus, the original support plate 2, as shown in FIG. 7, slides out by a dimension A from the side-wall carrying the handle 60 (leftwardly) and by that B from the side-wall carrying the rubber cushions 44 (rightwardly), in which a relation of $A>B$ holds. Hence, the handle 60 is mounted to the side-wall from which the original support plate 2 slides out more largely than the side-wall carrying the cushions 44.

Therefore, even when a person holds the handle 60 to raise the body 1 keeping the original support plate 2 movable, the plate 2 will fall down merely by the dimension B to thereby have extremely less fear of its breakdown.

Figure 8:
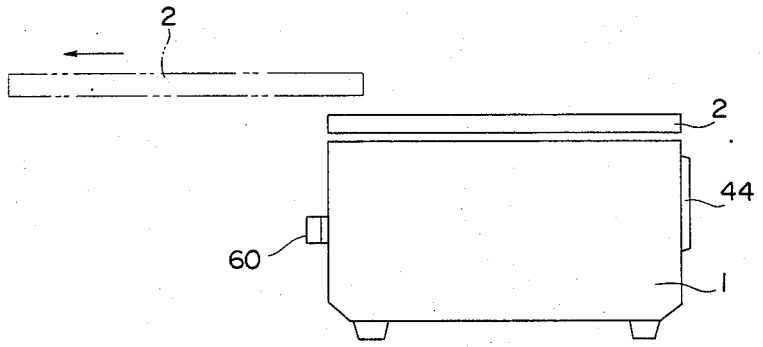
FIG. 8 is a schematic front view explanatory of operation of still another modified embodiment of the invention.

FIG. 8 is a schematic front view of still another modified embodiment, in which an original support plate 2 will slide out in only one direction from the body 1 and a handle 60 is fixed to the side-wall from which the plate 2 slides out.

This embodiment of electrostatographic apparatus, even when the body 1 is raised by the person holding the handle 60 keeping the original support plate 2 movable, can hold the plate 2 not at all to fall down, thereby requiring no locking unit therefor.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds thereof are therefore intended to be embraced by the claims.

What is claimed is:

1. An electrophotographic copying machine which is provided with an original support plate sliding in successive reciprocation along an upper surface of and laterally between and partially beyond front and rear sides of the body thereof, in the extremes of its frontward or rearward movement, respectively, characterized in that the center of gravity of said body is biased from the dimensional center of said body in the sliding direction of said original support plate toward the one of said front or rear sides of said body which said original support plate extends least beyond in its reciprocation, and also mounting on said one side a handle for transporting said machine, a sheet discharge tray and a sheet feed cassette slideably mounted through holes in said one side.

2. An electrostatographic apparatus as set forth in claim 1, wherein cushion members are mounted to the side wall counter to the handle mounted side.

3. An electrostatographic apparatus as set forth in claim 2, wherein said cushion members are belt-like shaped and extend vertically.

4. An electrostatographic apparatus as set forth in claim 3, wherein said cushion members extend to the bottom of said body.

5. An electrophotographic copying machine which is capable of not tilting upward from or otherwise moving upon its resting surface when said apparatus is in use, characterized in that with respect to a body thereof, onto either one of a front face or a rear face of said body is mounted a handle by which the body is transported, and only onto said one face are mounted accessories detachable or retractable with respect to said body, said accessories including a sheet discharge tray and a sheet feed cassette.

* * * * *